US006003188A

United States Patent [19]

Henry et al.

[11] Patent Number: 6,003,188

[45] Date of Patent: Dec. 21, 1999

[54] HANDLE FOR IMPLEMENTS SUCH AS HAIR CURLING BRUSHES

[75] Inventors: Charles T. Henry, Peachtree City; Yifang Chen, Duluth, both of Ga.

[73] Assignee: Goody Products, Inc., Peachtree City, Ga.

[21] Appl. No.: 09/096,211

[22] Filed: Jun. 11, 1998

[51] Int. Cl.[6] ..... A46B 5/00

[52] U.S. Cl. ..... 15/143.1; 15/145; 15/176.1; 16/421; 16/422

[58] Field of Search ..... 15/143.1, 145, 15/176.1; 16/421, 422, 431

[56] References Cited

U.S. PATENT DOCUMENTS

| | | | |
|---|---|---|---|
| 719,797 | 2/1903 | Heller | 15/145 |
| 2,133,252 | 10/1938 | Moore | 15/145 |
| 4,466,309 | 8/1984 | Matey | 16/421 |
| 5,299,475 | 4/1994 | Stroop | 16/421 |
| 5,581,838 | 12/1996 | Rocco | 15/145 |

FOREIGN PATENT DOCUMENTS 585387 12/1924 France .

*Primary Examiner*—Randall E. Chin
*Attorney, Agent, or Firm*—Foley & Lardner

[57] ABSTRACT

A handle assembly for brushes, curlers and the like is assembled without adhesives and includes, in a preferred embodiment, an elongate handle core, a bellows, an outer handle and a fastener. Assembly includes sliding the bellows over the core, placing the handle over the core and compressing the bellows to align at least one opening in the handle with at least one opening in the core. The fastener is then inserted. The fastener preferably includes at least one prong or cluster of prongs to pass through the opening of the handle and into the core. In the most preferred embodiment, the fastener prongs are resilient and expand within the core opening to lock the handle assembly together. One disclosed use of the handle is for hair curling brushes. In this embodiment, a cup is formed integrally with the core, the cup including an alignment rib and locking tabs. A first end of a cylindrical, metallic curling brush body is attached to the cup, and a cap is inserted into the second end of the barrel. Accordingly, the entire curling brush may be assembled without using adhesives.

24 Claims, 4 Drawing Sheets

HANDLE FOR IMPLEMENTS SUCH AS HAIR CURLING BRUSHES

CROSS-REFERENCES TO RELATED APPLICATIONS, IF ANY

None.

BACKGROUND OF THE INVENTION

1. Field of the Invention

The present invention relates generally to the art of multi-component handles which may be assembled without using adhesives, and more particularly to handles for tools and implements such as hair styling brushes, other brushes such as paint brushes, tools, such as garden tools, and the like. In its illustrated and most preferred form the present invention relates to a handle for hair curling brushes which may be assembled without the use of adhesives and in which one of the handle components is adapted to receive a first end of an elongate, cylindrical, metallic hair curling brush body.

2. Description of the Prior Art

A large number of implements in a large number of art areas include a handle to be grasped by the user. For example, hair styling accessories such as curling irons and brushes, paint brushes, tools, sporting goods, cookware and utensils, industrial equipment and many other devices include grips or handles to make use of the implement safer or more efficient, or to make the implements more attractive.

Exemplary of such prior art devices are hair curling brushes. Prior to the present invention, one popular style of curling brush includes a cylindrical, metallic brush body, brush bristles and a handle, the handle including a core, a bellows and an elastomeric outer covering attached to the core with a liquid adhesive. The bellows has been commonly included in recent brushes for aesthetic reasons and because the "feel" of the handle is improved if a portion of the handle yields under normal grip pressure to conform somewhat with the hand of the user.

Practical and economic problems exist with this design and in its assembly. From a practical standpoint, adhesives can lose their effectiveness over time, allowing components, or portions of the components, to release from one another. This problem is especially pronounced in devices, such as the hair curler described above, which is typically heated by a blow dryer held in the opposite hand by the user. The heat transferred from blower to brush body is detrimental to the adhesive bonding system, resulting in accelerated failure of the adhesive bond. The economic problems are caused by the time required to apply an adhesive during manufacture, equipment costs and, in some cases, by the costs of air pollution control equipment required for plant safety and for compliance with applicable environmental laws, rules and regulations.

Heat is also encountered with a number of other types of implements having handles or grips, such as the heat generated in cleaning devices such as dishwashers, or the heat which can build up during warm weather in storage buildings, such as lawn tool and garden sheds. Moreover, the practical and economical difficulties mentioned above for the curling brush are also present for these other products if a liquid adhesive is used to bond different pieces of a handle together.

To provide an inexpensive, reliable and widely adaptable technique of securing together multiple pieces of a handle for such tools and implements, to avoid the above-referenced and other problems would represent a significant advance in the art.

FEATURES AND SUMMARY OF THE INVENTION

A primary feature of the present invention is to provide a handle construction and an assembly method which overcome the above-noted disadvantages of the prior art.

Another feature of the present invention is to provide a construction for a handle and a method for its assembly which do not use a liquid adhesive for securing components to one another.

A different feature of the present invention is to provide a handle construction and assembly method which is readily adapted to a variety of tools and implements.

A further feature of the present invention is to provide a handle construction which may be made from a variety of different materials, including wood, elastomers, rigid plastics, metals and the like and which may be assembled by hand or automatically without the need of adhesives.

A still further feature of the present invention is to provide a handle construction which includes a variety of components which remain secured to one another without being affected by heat, cold or other environmental factors.

Yet a further feature of the present invention is to provide a handle construction which readily facilitates the addition of logos, trademarks or other identifying information in the handle on a single piece of the construction which may be varied from product to product without altering other components of the handle construction.

A feature of a preferred embodiment of the present invention is to provide a handle for hair styling accessories, including curling brushes, which facilitates the assembly of the entire product by hand or machine and without the use of adhesives.

A different feature of the present invention is to provide a handle construction for hair styling accessories wherein alignment of the various components is facilitated by structure of various components.

How these and other features of the present invention are accomplished will be described in the following Detailed Description of the Preferred Embodiment, taken in conjunction with the FIGURES. Generally, however, the present invention is accomplished using a handle construction which includes an elongate core having one or more openings therethrough, a handle which fits over the core and which includes one or more openings to be aligned with the openings of the core and a fastener which may be inserted into the handle and which includes one or more components which pass into or through the openings of the core to lock the components together. In a preferred and illustrated form of the present invention, the handle is used for a curling brush and the core includes a cup at one end for receiving the cylindrical elongate barrel of the curling brush. A bellows is provided about the core and a handle is provided over the core. By compressing the handle against the bellows, i.e. forcing the handle toward the cup, the holes in the core and the handle become aligned for receiving the fastener, which may be inserted by hand or by a machine. The fastener, in the most preferred and illustrated embodiment, includes a plate having one or more resilient fastener prongs extending therefrom. The prongs may be in groups and may be compressed by the initial insertion into the openings and which then expand to lock the fastener into position and prevent removal thereof. The fastener plate provides a convenient location for the addition of a logo, trademark or other identifying symbol for the particular tool or implement with which the handle is employed. Other ways in which the features of the present invention are accomplished will readily appear to those skilled in the art after they read and understand the present specification. Such other ways are deemed to fall within the scope of the present invention if they fall within the scope of the claims which follow.

DESCRIPTION OF THE DRAWINGS

Certain embodiments of the present invention are illustrated in the following drawings in which like reference numerals are used to indicate like components.

DETAILED DESCRIPTION OF THE PREFERRED EMBODIMENT

Figure 1:
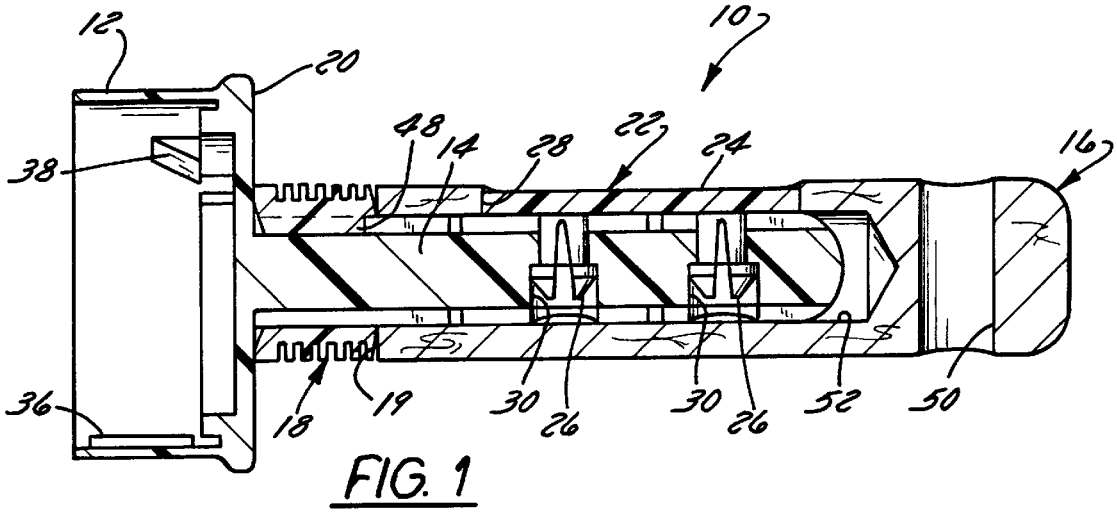
FIG. 1 is a side view, partially in section, showing the most preferred embodiment of the present invention in the form of a handle for a hot curling brush.

Before proceeding to the detailed description of the preferred and illustrated embodiment of the present invention, several comments can be made about the general applicability and the scope thereof.

First, the illustrated hot curling brush made of several components without the use of adhesive is the most preferred form of the invention, but the handle construction and assembly techniques to be described shortly have a wide variety of application for other tools, implements and accessories. For example, the handle construction can be used for all of the variety of implements and tools described in the "Background" section of this specification.

Second, the particular materials used to construct the most preferred embodiment are also illustrative. For example, the cup and core component of the hot curling brush can be made from plastics or metals, while the outer handle can be made from wood, plastic, rubber, metal and a variety of other materials known to those familiar with the art. The bellows employed in the most preferred embodiment may be prepared from natural rubber or various synthetic elastomers as also will be appreciated by those familiar with the art.

Third, the fastener may be made from metal or plastics, some resiliency being preferred for the fastener prongs to be described below.

Fourth, the cup employed with the FIG. 1 hot curling brush embodiment is preferred for that embodiment and need not be present to employ the handle construction and assembly techniques described later in the specification. In the illustrated embodiment, the cup receives an elongate barrel of the hot curling brush, the only portion of the cup actually participating in the handle construction and assembly being the outside circular flange extending around the core. This aspect of the invention and the requirements for such a flange in some circumstances will become more apparent as the detailed description continues.

Fifth, the handle construction and assembly techniques described in this specification may be used with other hot curling brush and hair styling accessories than the one specifically illustrated. For example, the handle construction and assembly techniques could be used with a core secured to or formed integrally with an elongate barrel, as opposed to one in which a cup surrounding the barrel is formed as a separate piece with the core attached thereto.

Sixth, the hole through the outer handle in the illustrated embodiment is for illustration purposes and should not be taken as limiting. Such holes are frequently provided to facilitate the hanging thereof either at the place of use or at the point of sale.

Finally, the present invention is illustrated with two sets of fastener prongs extending into holes within the core. The present invention may be constructed with only a single set of prongs extending from the fastener plate or more than two sets of prongs may be employed. Accordingly, while the fastener system is an important component of the present invention, the particular number of prongs is not. Furthermore, the plate employed with the fastener in the illustrated embodiments is generally oval in plan view, but can be circular, square, rectangular or any other shape.

Proceeding now to the Detailed Description of the Preferred Embodiment, FIG. 1 shows in side view, partially in section, the major features of the handle 10 according to the present invention. Handle 10 includes cup 12 at one end, the cup having a generally circular opening extending toward the left in this view and an elongate core 14 extending, in this embodiment, from the outside center of the cup toward the right. A wooden outer handle 16 is shown disposed over the core. A bellows 18 is located between the inner end 19 of handle 16 and the bottom 20 of cup 12. Finally, a fastener 22 is shown to include a plate 24 and a plurality of prongs 26. From FIG. 1 it can be noted that the plate of fastener 22 fits within a recess 28 in handle 16 and that openings 30 are provided in the core for receiving the prongs. Greater details of the particular components of the handle construction will be provided in connection with the description of the remaining drawings.

Figure 7:
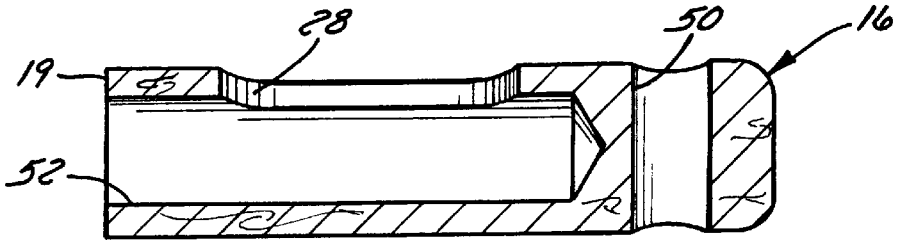
FIG. 7 is a sectional view taken along the lines 7—7 of FIG. 6.
Figure 8:
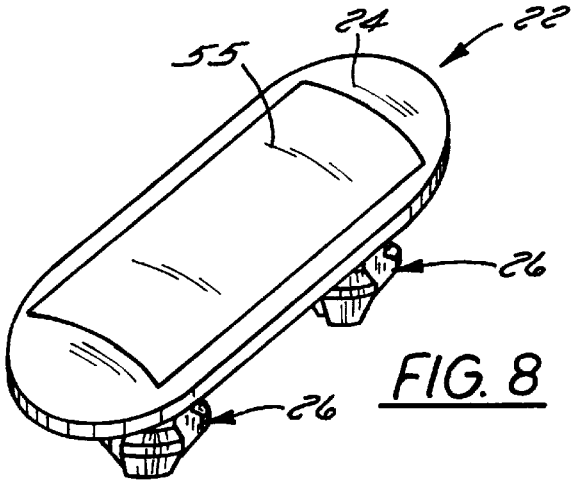
FIG. 8 is a perspective view of the fastener used for the handle of FIG. 1.
Figure 9:
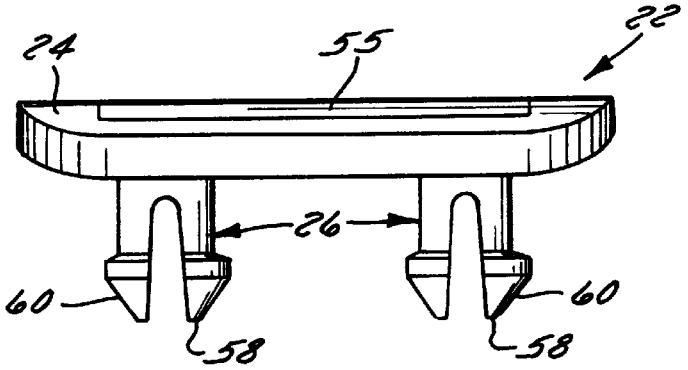
FIG. 9 is a side view of the fastener as shown in FIG. 8.
Figure 10:
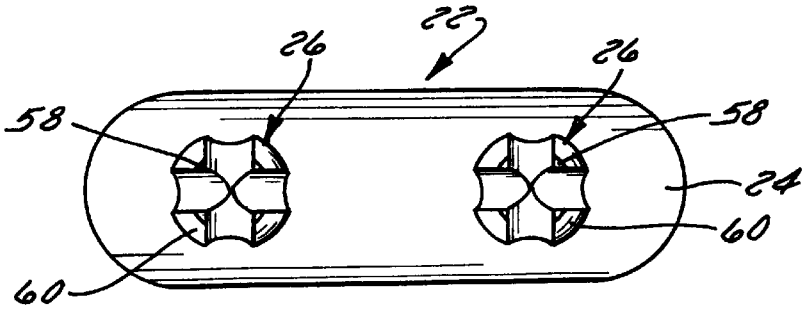
FIG. 10 is a bottom view of the fastener as shown in FIGS. 8 and 9.

It will assist in understanding the remainder of the invention to briefly describe how the handle construction of FIG. 1 is assembled. The core component (described in greater detail in FIGS. 2 and 3) receives the bellows (shown best in FIGS. 4 and 5) after which the handle (shown in FIG. 7) is placed over the core 14. The fastener shown in FIGS. 8–10 is located over recess 28 in handle 16 and, while handle 16 is urged toward cup 12, the fastener prongs 26 are pressed into the openings 30 when they are exposed. As will become more apparent later in this description, the prongs will securely and irreversibly attach the components, without the need of adhesives.

Figure 2:
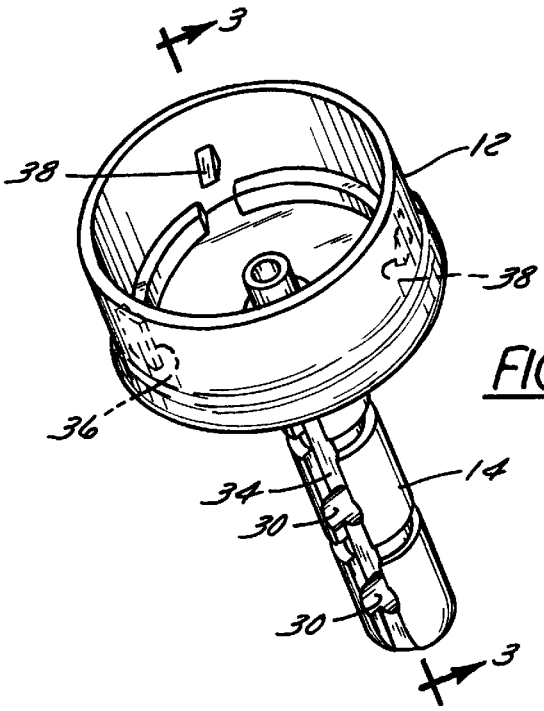
FIG. 2 is a perspective view of the core and cup components of the handle shown in FIG. 1.

Proceeding next to FIG. 2, a perspective of the cup and core component, several additional features are illustrated. First, an elongate groove is provided along core 14 to assist in aligning the bellows component as will become more apparent later in this description. It is also apparent from this drawing that the core itself is cylindrical, although other core configurations could be used without departing from the spirit or the scope of the invention. Other features of the cup 12 include a rib 36 arranged along a side of the cup 12 and a pair of tabs 38 (only one of which is apparent from FIG. 2) arranged at opposite sides of the cup. As will be fully appreciated after the last few FIGURES (11–12) of this application are described, rib 36 aligns the barrel of the curling brush so that locking tabs 38 may be inserted into the mating openings of the barrel.

Figure 3:
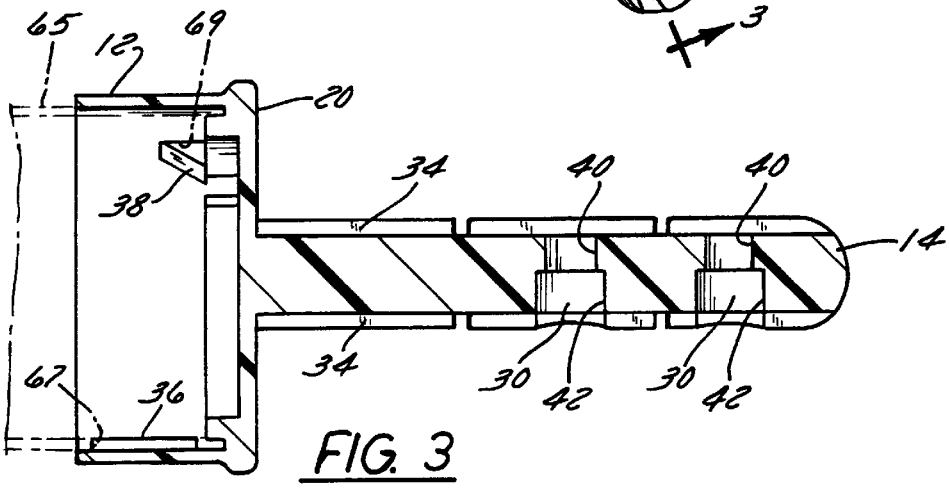
FIG. 3 is a sectional view taken along the line 3—3 of FIG. 2 illustrating the openings through the core.

FIG. 3 is another view of the cup and core component and is provided to show the particular nature of the openings 30 described previously. They extend from one side of the core transversely through to the other side and are generally round. However, it will be noted that the opening includes two diameters on the opposed sides. At one side, and to the approximate midpoint of the core, the openings 30 have a first diameter portion 40, whereas a second larger diameter portion 42 is provided for the remainder of the openings 30. It can be indicated here that the prongs are first inserted into the smaller diameter portion 40 of openings 30 and may be compressed in this step and that when the prongs pass the annular flange between the two portions of the opening, they will snap outwardly into the larger diameter portion section 42 and prevent subsequent removal of the prongs.

Figure 4:
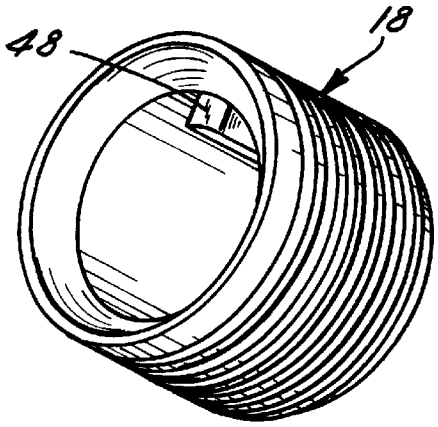
FIG. 4 is a perspective view of the bellows component of the handle shown in FIG. 1.
Figure 5:
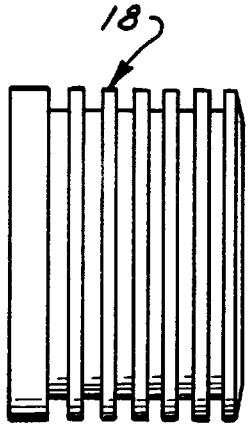
FIG. 5 is a side view of the bellows shown in FIG. 4.

The bellows component is shown in perspective and side view in FIGS. 4 and 5 and a feature thereof is apparent in FIG. 4, namely a rib 48 constructed and arranged to slide within groove 34 of the core to properly align the bellows with that component during assembly.

Figure 6:
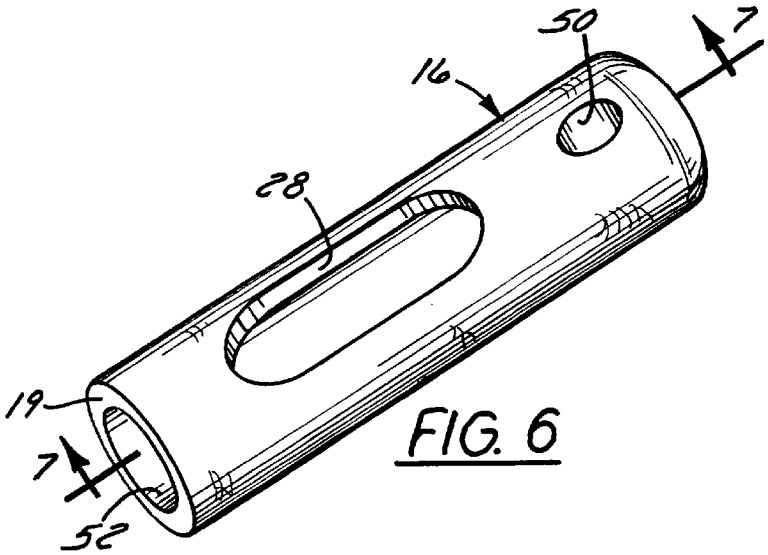
FIG. 6 is a perspective view of the outer handle of the handle construction of FIG. 1.

Proceeding next to FIG. 6, the handle 16 is shown in perspective form to include a transverse through hole 50 and a longitudinal and axially arranged opening 52, the latter being sized to fit over core 14. The opening 28 for receiving the fastener is also readily apparent in this drawing. By reference to FIG. 7, a sectional view of the handle, it is apparent that axial opening 52 does not extend entirely through the handle but stops short of the transverse through hole 50. It is also apparent from this view, taken in conjunction with FIG. 6, that the fastener opening 28 is oval in configuration and is adapted to support the fastener plate 22 in such a manner that its outer surface generally coincides with the outer surface of handle 16.

Proceeding next to FIG. 8, the fastener, according to the most preferred embodiment, is illustrated in perspective form. As indicated previously, the fastener plate is oval but can be variously embodied. Moreover, in the illustrated fastener 22, a rectangular frame panel 55 is molded in its upper surface which may be used for, among other things, application of a logo, trademark or other identifying information for the particular product with which the handle construction 10 will be used.

Further construction details of the fastener 22 become readily apparent in FIGS. 9 and 10, more specifically, the prongs 26. In the preferred embodiment, the fastener is made from plastic and by reference to FIG. 9 it will be noted that the separation of the four individual prongs 26 in each grouping thereof provides for some flexibility to allow compression of the tips 58 of the prongs toward one another as the fastener is inserted into openings 30. More specifically, it will be noted by reference to FIGS. 1, 9 and 10 that the prongs themselves are formed so that the tips 58 will compress as the fastener is inserted through the smaller diameter portions 40 and will snap apart to their nominal configuration in the wider diameter portions 42 of the openings 30. To facilitate such compression and expansion, the prongs may include a generally conical lower surface 60.

This is an appropriate time in the description to again point out that the number of prongs in each grouping, the number of groupings of prongs, the shape of the fastener plate and the opening in the core can be widely varied for aesthetic purposes or to enhance particular properties of individual implements. The present inventors have found, however, that two spaced apart sets of prongs and two openings in the core provides a sturdy construction which may be used for frequent use applications such as a hair curling brush, without deterioration during use.

Figure 11:
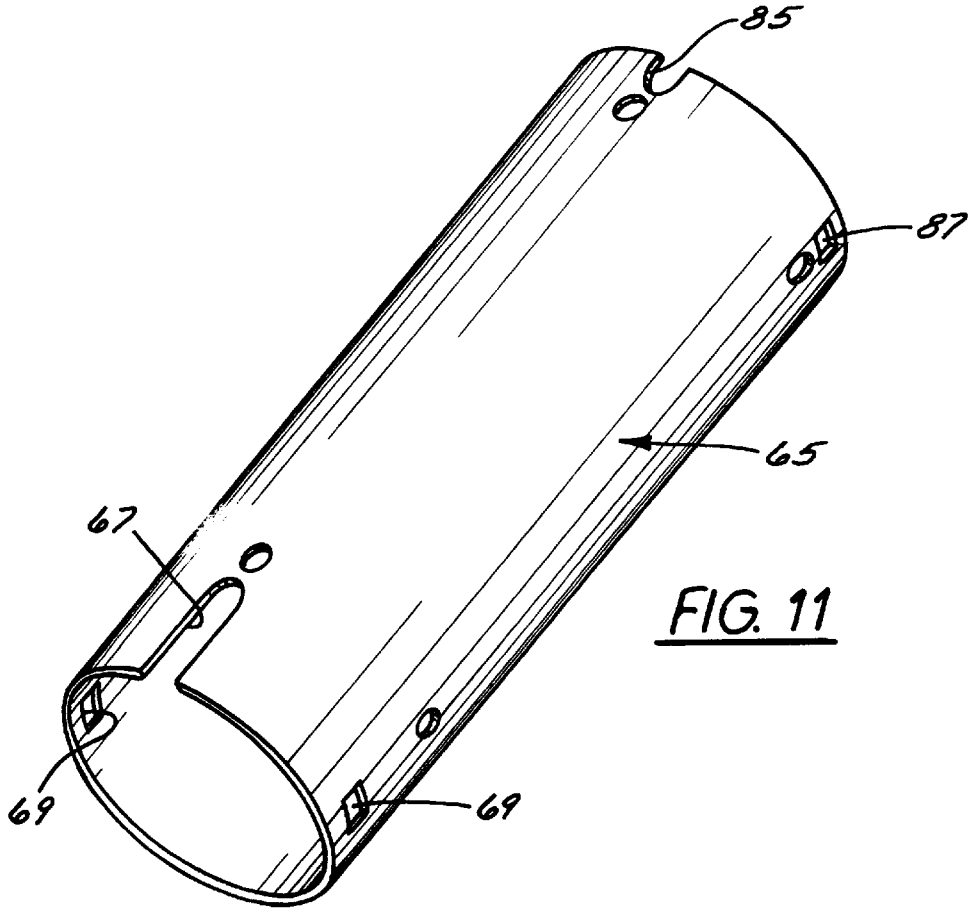
FIG. 11 is a perspective view of the barrel of the hot curling brush useable with the handle of FIG. 1.
Figure 12:
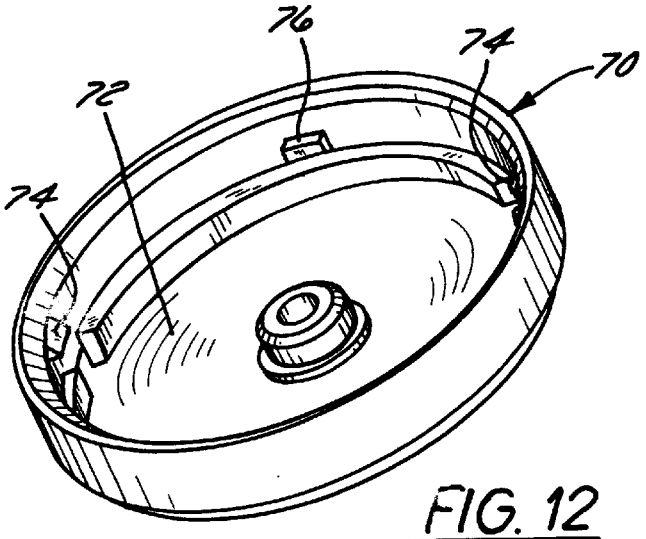
FIG. 12 is a perspective view of a cap for the barrel shown in FIG. 11.

To complete the description of the preferred curling brush, reference should next be directed to FIGS. 11 and 12. In these FIGURES, the components to be added to the handle construction to create a hair curling brush are described. FIG. 11 illustrates a cylindrical barrel 65 having a longitudinal slot 67 at a first end thereof. This slot mates with the rib 36 illustrated in FIG. 2. Also located in this area of the barrel 65 are a pair of rectangular openings 69 used for capturing the tabs 38 also shown in FIG. 2. From this description, it will be readily apparent that barrel 65 may be inserted into cup 12 by aligning slot 67 with rib 36 and urging the two components together until the tabs 38 interact to lock the barrel into place.

A cap 70 for the opposite end of the barrel is shown in FIG. 12. The cap includes an outer plate 72, a pair of locking tabs 74 and at least one alignment rib 76. These latter components are adapted to engage an alignment slot 85 at the outer end of barrel 65 and a pair of openings 87 adapted to receive the tabs. Obviously, for a metal, hair curling brush, bristles would be provided for core 65 as is already known in the art. Since they do not form part of the present invention, they are not illustrated. The structure illustrated in FIGS. 11 and 12 allow total assembly of the curling brush without the use of adhesives. In prior metal curling brushes known to applicants, an adhesive was used for securing the barrel to a cup-like component, such adhesive assembly being subject to the same types of problems as discussed for the handle component.

While a single preferred embodiment of the present invention has been described above, the invention is not to be limited thereby, but is to be limited solely by the scope of the claims which follow.

What is claimed is:

1. A handle construction for a tool or implement comprising:

an elongate core;

an elongate handle having a wall constructed to slidingly surround the core;

an opening through the handle wall;

at least one transverse opening into the core;

the opening of the handle and the at least one core opening being aligned when the handle is slidingly disposed along the core at a first position; and a fastener plate received in the handle opening and including resilient prongs extending into the at least one core opening to secure the core, handle and fastener together.

2. The handle construction of claim 1 wherein the at least one core opening is circular and has a first smaller diameter portion nearer the opening in the handle and a second larger diameter portion remote from the handle opening.

3. The handle construction of claim 2 wherein the first and second core portions together extend through the core.

4. The handle construction of claim 2 wherein the prongs are a cluster of resilient prongs and wherein the cluster is compressed inwardly when the prongs are inserted into the smaller diameter portion of the at least one core opening and expand outwardly when the lower surfaces thereof pass into the larger diameter portion of the at least one core opening.

5. The handle construction of claim 4 wherein the lower surfaces of the prongs are conically tapered to facilitate insertion of the prongs.

6. The handle construction of claim 1 wherein a resilient member surrounds the core and has an end abutting an end of the handle, the resilient member preventing alignment of the handle opening and the at least one core opening when the ends abut one another without longitudinal pressure, and wherein alignment of the openings occurs when the resilient member is compressed laterally.

7. The handle construction of claim 6 wherein the resilient member is a generally cylindrical bellows made from an elastomeric material.

8. The handle construction of claim 7 wherein the core and bellows each include a component to ensure rotational alignment of the bellows when the bellows is placed over the core.

9. The handle construction of claim 1 wherein a cup is attached to an end of the core, the cup having a cylindrical wall which is coaxial with the core and a circular bottom.

10. The handle construction of claim 9 wherein a bellows surrounds the core and the handle is disposed about the core so that the bellows is located between a first inner end of the handle and the cup bottom and wherein the opening of the handle and the at least one core opening are aligned only when the first end of the handle is urged toward the cup bottom to compress the bellows from its normal length to a shorter length.

11. A hair brush construction comprising a cylindrical barrel and a multi-component handle, which construction may be fully assembled without the use of adhesives, the construction comprising:

a handle and a cylindrical cup for receiving a first end of the brush barrel, the cup having a wall and a bottom, the handle comprising an elongate core attached to and coaxial with the cup and extending from the cup bottom in a direction opposite from the cup wall, a handle surrounding the core and being slidably disposed therealong, the handle having a first end located nearer the cup bottom and a second outer end, at least one transverse opening in the handle and extending through the handle to expose the core and at least one opening in the core adapted to be aligned with the handle opening when the handle is slidingly moved along the core to a first position, and a fastener extending into the aligned openings to secure the core, handle and fastener together; and an elastomeric member provided about the core intermediate the first end of the handle and the cup bottom, the member preventing alignment of the openings unless the handle is moved toward the cup bottom to at least partially compress the elastomeric member.

12. The brush of claim 11 wherein the elastomeric member is a generally cylindrical bellows.

13. The brush of claim 11 wherein the core is generally round in cross-section and the handle includes a cylindrical portion for being slidingly disposed over the core, the handle opening being through the cylindrical portion of the handle.

14. The brush of claim 11 wherein the at least one core opening is circular and has a first smaller diameter portion adjacent the at least one opening in the handle and a second larger diameter portion remote from the at least one opening in the handle.

15. The brush of claim 14 wherein the fastener includes a fastener plate adapted to be received in the at least one handle opening and at least one cluster of resilient prongs extending perpendicularly from the plate.

16. The brush of claim 15 wherein the at least one cluster is compressed inwardly when the prongs are inserted into the smaller diameter portion of the at least one core opening and expand outwardly when the lower surfaces thereof pass into the larger diameter portion of the at least one core opening.

17. The brush of claim 16 wherein the lower surfaces of the prongs are conically tapered to facilitate insertion of the prongs.

18. The brush of claim 11 wherein the barrel includes openings adjacent a first end thereof and the cup includes locking tabs constructed and arranged to engage the barrel openings to secure the barrel to the cup without the use of adhesives.

19. The brush of claim 18 wherein the cup includes at least one alignment rib and the barrel includes at least one slot at the end thereof to be inserted in the cup to ensure alignment of the barrel openings and the locking tabs when the barrel is inserted in the cup.

20. The brush of claim 19 wherein a cap is provided for the end of the barrel remote from the cup, the cap including locking tabs and the barrel including openings arranged so that the cap may be secured to the barrel without the need for adhesives.

21. A hair styling accessory including a hair styling portion and a handle, the handle including an elongate, generally cylindrical core extending from the hair styling portion, a handle having an axial opening therein slidingly disposed over the core, an opening extending through the wall of the handle, at least two openings in the core, at least one of the at least two core openings being aligned with the handle opening when the handle is slidingly moved along the core to a first position, a fastener plate within the handle opening and fastener elements extending from the plate into the at least two core openings to lock the handle, core and fastener together without the need for adhesives.

22. The accessory of claim 21 wherein an elastomeric bellows is provided between the hair styling portion and the handle to prevent alignment of the handle opening and at least one of the at least two core openings unless the handle is slidingly moved toward the hair styling portion to compress the bellows.

23. The accessory of claim 21 wherein the fastener elements include a cluster of prongs for at least one of the at least two core openings the prongs each including tapered ends remote from the plate for facilitating insertion of the prongs.

24. The accessory of claim 21 wherein the handle opening and the fastener plate are oval in shape and wherein two fastener elements are provided for engaging two of the at least two openings.

* * * * *